United States Patent [19]

Marker

[11] Patent Number: 4,466,375

[45] Date of Patent: Aug. 21, 1984

[54] MAST FOOT FOR SAILING BOARDS

[75] Inventor: Hannes Marker, Garmish-Partenkirchen, Fed. Rep. of Germany

[73] Assignee: Hannes Marker GmbH & Co. Vertriebs K.G., Garmisch-Partenkirchen, Fed. Rep. of Germany

[21] Appl. No.: 315,226

[22] Filed: Oct. 26, 1981

[30] Foreign Application Priority Data

Oct. 24, 1980 [WO] PCT Int'l Appl. ..... PCT/EP80/00117

[51] Int. Cl.[3] ..... B63B 15/00

[52] U.S. Cl. ..... 114/90; 441/74

[58] Field of Search ..... 40/411, 608; 114/39, 114/357, 91, 90; 403/78, 123, 164, 165; 215/33; 285/238, 330; 441/74

[56] References Cited

U.S. PATENT DOCUMENTS

| | | | |
|---|---|---|---|
| 1,384,365 | 7/1921 | Walsh | 40/608 |
| 3,485,201 | 12/1969 | Kelley | 40/608 |
| 4,166,425 | 9/1979 | Kummetz | 114/357 |
| 4,236,476 | 12/1980 | Solf | 114/91 |
| 4,273,062 | 6/1981 | Marker | 114/91 |

*Primary Examiner*—Trygve M. Blix
*Assistant Examiner*—C. T. Bartz
*Attorney, Agent, or Firm*—Fleit, Jacobson, Cohn & Price

[57] ABSTRACT

A mast foot for sailing boards comprising a holder securable to the sailing board and a connector which is connected to the holder by a universal joint and can be connected to the mast. The holder and connector are provided with curved faces which frictionally roll on each other during movement, in all directions, and which positively interengage to provide the universal joint. The holder and connector are held together by an elastic tension member. In one embodiment, the older is a half cup and the connector is a bearing sphere supported by the half cup. In another embodiment, the holder is provided with a ring having a bead-like edge and the connector has a complementary annual groove.

3 Claims, 3 Drawing Figures

MAST FOOT FOR SAILING BOARDS

BACKGROUND OF THE INVENTION

Field of the Invention

The invention relates to a mast foot for sailing boards, comprising a holder securable to the sailing board and a connector which is connected to the holder by a universal joint and can be connected to the mast.

If the mast is released by the surfer and it falls onto the water in a position substantially parallel to the sailing board, the mast foot should be easily releasable from the sailing board to avoid injuries to the surfer by limbs being jammed between the mast and board. The releasability of the mast foot from the sailing board often also leads to undesired separation of the two parts, so that the surfer must first reconnect them before he can use the device again.

SUMMARY OF THE INVENTION

It is therefore the object of the invention to provide a pivot for a mast foot that on the one hand permits easy release of the mast from the sailing board but on the other hand avoids manipulations for reconnecting to the board after such release.

According to the invention, this problem is solved in that the holder and connector are provided with curved faces which frictionally roll on each other during movement of the holder and connector in all directions and which positively interengage, and that the holder and connector are held together by an elastic tension member. In the normal operative position, the elastic tension member holds the holder and connector together so that a universal joint is formed by their curved faces which frictionally roll on each other. However, if forces act on the mast seeking to release the pivot connection, the elastic tension member permits separation of the pivot connection so that injuries to the user are avoided. To resume use, the elastic tension member pulls the mast up again and automatically reestablishes the pivot connection, so that special manipulations for reconnecting the mast foot to the sailing board are not required.

Particularly simple reassembly of the pivot parts is achieved in that the holder is provided with a ring having a bead-like edge and the connector with a complementary annular groove. The elastic tension member holding the two parts together pulls the connector up after a separation, the latter being pulled onto the bead-like edge with its annular groove and thereby automatically reestablishing the pivot connection.

To suit current wind or wave conditions, it is desirable for the surfer to be able to adjust the mast lengthwise of the sailing board during surfing, without having to dismantle the mast. In another form of the invention, it is therefore provided that the holder is secured to or in the form of a carriage slidable along a guide extending along the central axis of the sailing board. Simple adjustability for the surfer is obtained in that the carriage is pivoted to a pedal which is so connected by way of a lever device to a spring loaded detent engaging in locking recesses of the guide that, on depressing the pedal, the detent is disengaged from the respective locking recess.

BRIEF DESCRIPTION OF THE DRAWINGS

Examples of the invention will hereinafter be described in more detail with reference to the drawing, wherein.

DESCRIPTION OF THE PREFERRED EMBODIMENT

Figure 1:
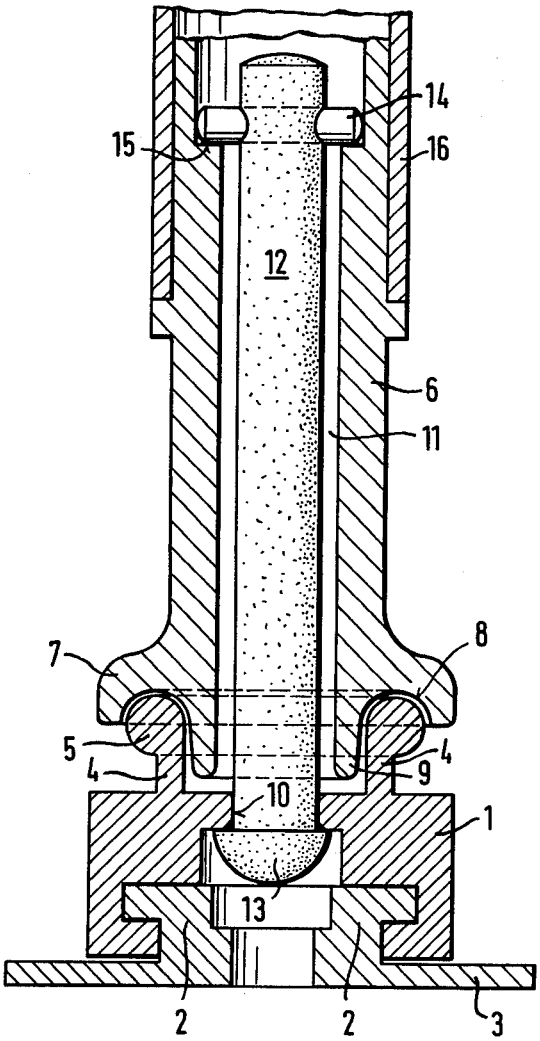
FIG. 1 is a longitudinal section through a first embodiment of a mast foot longitudinally slidable on a carriage.
Figure 2:
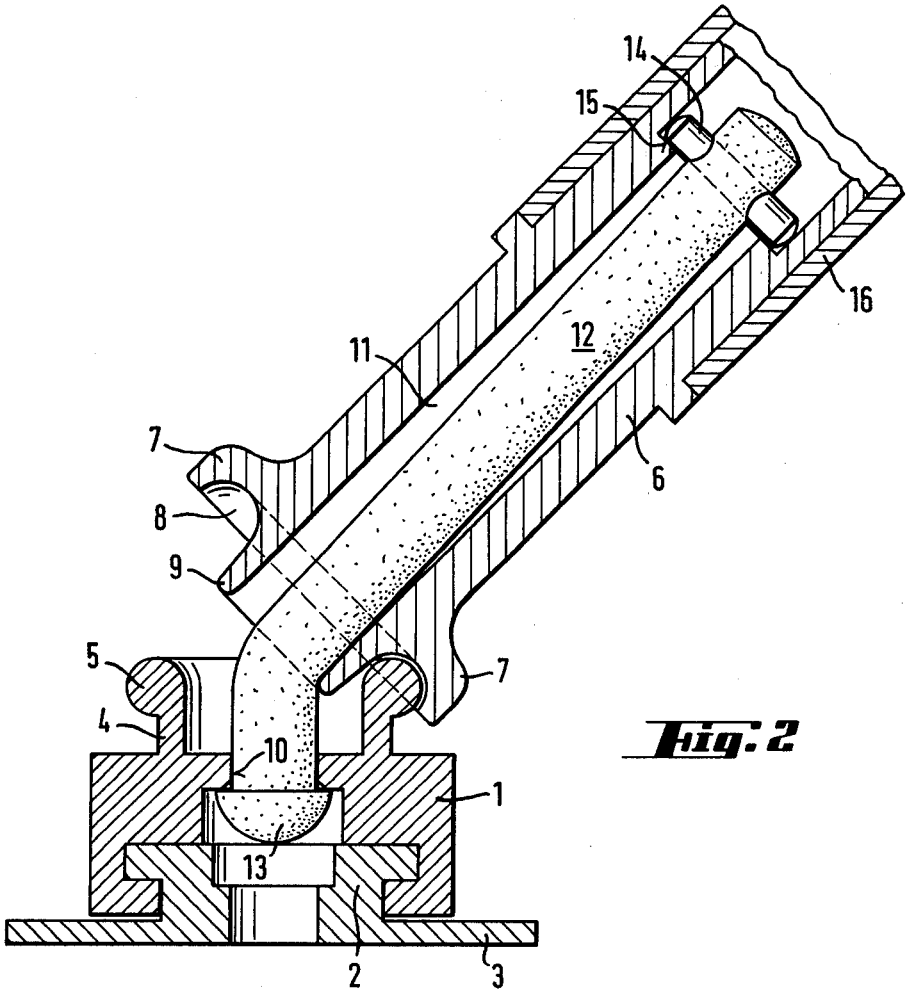
FIG. 2 shows the mast foot of FIG. 1 in an angled position of the connector.
Figure 3:
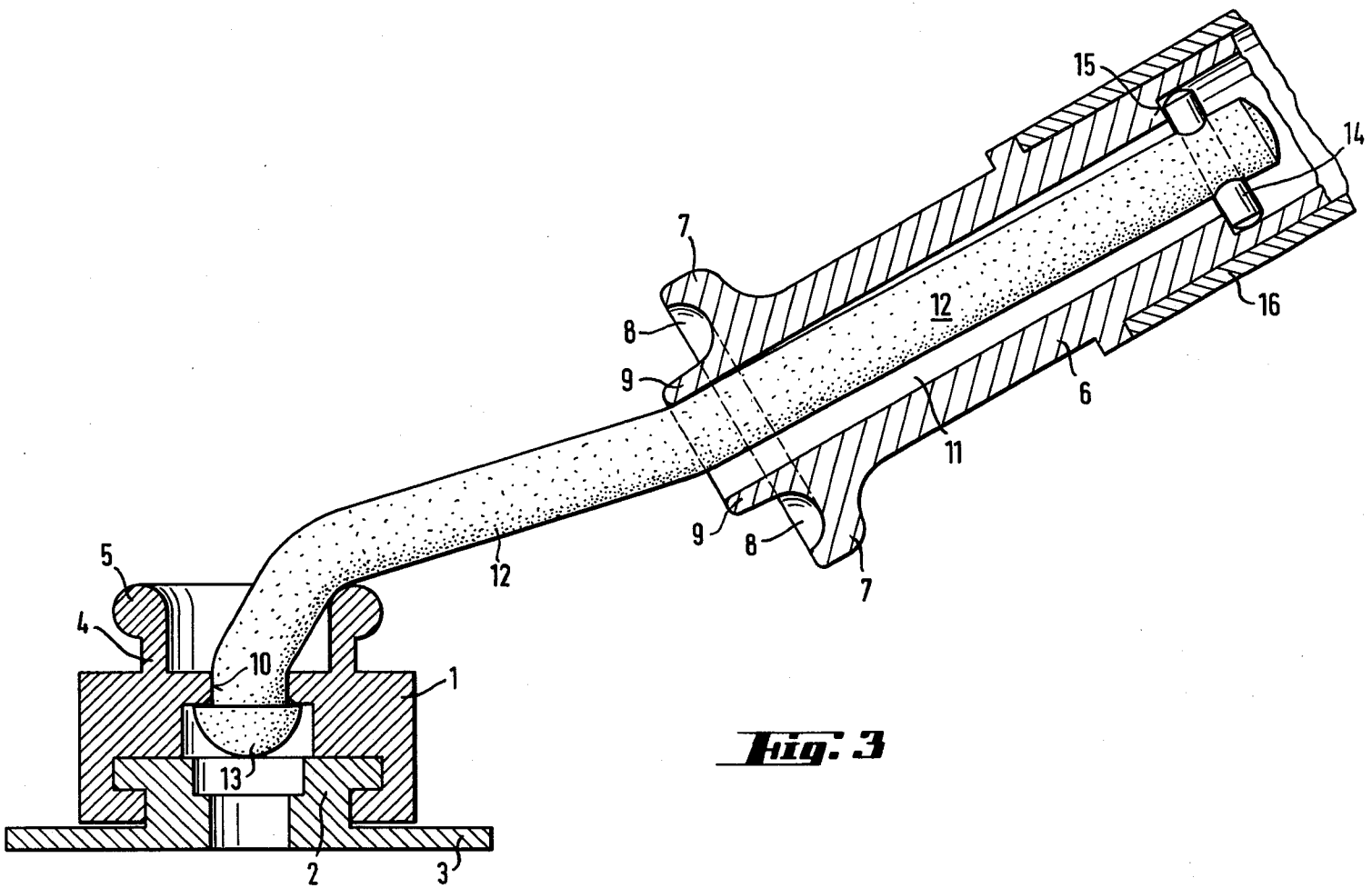
FIG. 3 shows the FIG. 1 and FIG. 2 mast foot with the connector withdrawn.

In FIGS. 1 to 3, the holder 1 is in the form of a carriage longitudinally displaceable on a T-shaped guide member 2. The guide member 2 is provided with a base plate 3 which can be secured on the sailing board.

The holder 1 has a collar-like ring 4 provided with a bead-like edge 5. The lower part of the connector 6 has a flange-shaped collar 7 which, on the side facing the bead-like edge 5, has a suitable annular groove 8 of a shape adapted to that of the bead-like edge 5. The connector 6 has a central extension 9 which in conically tapered and with which the connector 6 engages in the ring 4 at a level below that of the bead-like edge 5.

The holder 1 and connector 6 are provided with central bores 10, 11 receiving a rubber band 12 which interconnects the parts. The rubber band 12 has an enlarged lower head 13 with which it is located in an enlarged space of the holder 1 beyond the edge of the bore 10. Instead of the enlarged head 13, there may be retaining washers or other securing means for the rubber band.

At the opposite end, the rubber band 12 has a retaining pin 14 passing therethrough, the ends of which are supported on an annular shoulder 15 formed beyond the bore 11. The ends of the pin 14 can slide on the annular shoulder 15 so that the connector 6 can be turned with respect to the holder 1 without marked twisting of the rubber band 12.

The mast 16 is secured on the connector by sliding it on, or otherwise.

The bead-like edge 5 and the annular groove 8 form a pivot connection in that the holder and connector 6 are so held together under the resilient stress of the rubber band 12 that the annular groove 8 of the connector 6 is supported on the bead-like edge 5 of the holder 1. This support is ensured in the manner of FIG. 2 even when the connector 6 is pivoted relatively to the holder 1.

If a stronger pull is exerted on the connector 6, the rubber band 12 is stretched as shown in FIG. 3, so that the connector 6 can be separated from the holder 1. The rubber band 12 seeks to reestablish the pivot connection in that it pulls the connector 6 towards the holder 1. The annular groove 8 automatically engages the bead-like edge 5.

What is claimed is:

1. A mast foot for sailing boards comprising: a holder securable to a sailing board and a connector which is connected to the holder by a universal joint and can be connected to the mast, the holder and connector provided with curved faces which frictionally roll on each other during movement in all directions and which positively interengage, the holder and connector held together by an elastic tension member, and the holder on the one hand and the connector on the other hand provided with a ring having a bead-like edge and a complementary annular groove.

2. A mast foot according to claim 1, characterised in that the ring with a bead-like edge is provided on the holder.

3. A mast foot according to one of claims 1 or 2, wherein the elastic tension member consists of a rubber band which is held by a rotary connection at least in the holder or connector.

* * * * *